US012116778B2

(12) United States Patent
Park

(10) Patent No.: US 12,116,778 B2
(45) **Date of Patent: *Oct. 15, 2024**

(54) BRICKS EXHIBITING NEGATIVE POISSON'S RATIO

(71) Applicant: Joon Bu Park, Las Vegas, NV (US)

(72) Inventor: Joon Bu Park, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/526,823

(22) Filed: Dec. 1, 2023

(65) Prior Publication Data

US 2024/0117629 A1 Apr. 11, 2024

Related U.S. Application Data

(63) Continuation of application No. 17/672,048, filed on Feb. 15, 2022, now Pat. No. 11,873,637.

(51) Int. Cl.

| | |
|---|---|
| ***E04B 2/22*** | (2006.01) |
| ***E04B 2/18*** | (2006.01) |
| *E04B 2/02* | (2006.01) |

(52) U.S. Cl.
CPC ..... *E04B 2/22* (2013.01); *E04B 2/18* (2013.01); *E04B 2002/021* (2013.01)

(58) Field of Classification Search
CPC ..... E04B 2/22; E04B 2/18; E04B 2002/021
See application file for complete search history.

(56) References Cited

U.S. PATENT DOCUMENTS

| | | | |
|---|---|---|---|
| 3,435,576 | A | 4/1969 | Giannelia |
| 3,783,571 | A | 1/1974 | Horvath |
| 4,034,533 | A | 7/1977 | Faas |
| 4,041,660 | A | 8/1977 | Yensen |
| 6,606,835 | B1 | 8/2003 | Bilka |
| 7,160,621 | B2 | 1/2007 | Chaudhari et al. |
| 11,873,637 | B2 | 1/2024 | Park |
| 2009/0301020 | A1 | 12/2009 | Belliveau |
| 2014/0044951 | A1 | 2/2014 | Beals et al. |
| 2019/0070824 | A1 | 3/2019 | Bargatin et al. |
| 2020/0346420 | A1 | 11/2020 | Friedrich |
| 2023/0257993 | A1 | 8/2023 | Park |

FOREIGN PATENT DOCUMENTS

| | | |
|---|---|---|
| CN | 204509989 | 7/2015 |
| CN | 106495592 | 3/2017 |
| CN | 106499121 | 3/2017 |
| CN | 106630818 | 5/2017 |

(Continued)

OTHER PUBLICATIONS en.wikipedia.org [online], "Brick," Dec. 19, 2003, retrieved on May 13, 2022, retrieved from URL <https://en.wikipedia.org/wiki/Brick>, 18 pages.

(Continued)

*Primary Examiner* — Patrick J Maestri
(74) *Attorney, Agent, or Firm* — Fish & Richardson P.C.

(57) ABSTRACT

A brick includes outer walls defining a hollow interior space, the outer walls including: substantially flat top and bottom walls; and side walls angled inwards toward a central portion of the NPR brick, such that application of a compressive force between the top and bottom walls causes a lateral dimension of the brick between opposite side walls to decrease. At least some of the outer walls of the brick include a material having a negative Poisson's ratio (NPR).

22 Claims, 9 Drawing Sheets

(56) References Cited

FOREIGN PATENT DOCUMENTS

| | | |
|---|---|---|
| CN | 108558312 | 9/2018 |
| CN | 110041019 | 7/2019 |
| CN | 111706003 | 9/2020 |
| CN | 212613369 | 2/2021 |
| CN | 112553391 | 3/2021 |
| CN | 112813881 | 5/2021 |
| CN | 112945431 | 6/2021 |
| GB | 2495272 | 4/2013 |
| IN | 1525DEL2005 | 12/2006 |
| WO | WO 2021/077667 | 4/2021 |

OTHER PUBLICATIONS

International Search Report and Written Opinion in International Appln. PCT/US2023/62596, mailed on Jul. 19, 2023, 9 pages.

BRICKS EXHIBITING NEGATIVE POISSON'S RATIO

CROSS-REFERENCE TO RELATED APPLICATIONS

This application is a continuation application of and claims the benefit of priority to U.S. application Ser. No. 17/672,048, filed on Feb. 15, 2022, the contents of which are hereby incorporated by reference.

BACKGROUND

The present disclosure relates generally to construction materials, such as bricks.

SUMMARY

We describe here construction materials, such as bricks, that exhibit a negative Poisson's ratio ("NPR bricks"). A brick can exhibit a negative Poisson's ratio because of its shape, because it is formed of a material having a negative Poisson's ratio (an "NPR material"), or both. NPR bricks can absorb energy efficiently, thereby exhibiting greater tensile strength, flexibility, impact resistance, and durability than comparable bricks with a positive Poisson's ratio. Brick walls can be formed of a combination of NPR bricks and bricks that exhibit a positive Poisson's ratio ("PPR bricks), which enables efficient energy absorption and provides structural integrity to the wall.

In an aspect, a brick includes outer walls defining a hollow interior space, the outer walls including: substantially flat top and bottom walls; and side walls angled inwards toward a central portion of the NPR brick, such that application of a compressive force between the top and bottom walls causes a lateral dimension of the brick between opposite side walls to decrease. At least some of the outer walls of the brick include a material having a negative Poisson's ratio (NPR).

Embodiments can include one or any combination of two or more of the following features.

The at least some of the outer walls of the brick include an NPR foam material, such as an NPR ceramic foam or an NPR polymer foam. In some cases, the NPR foam material includes an isotropic NPR foam material.

At least some of the side walls each defines a corner that points toward the central portion of the NPR brick.

At least some of the side walls each defines a concave profile.

The top, bottom, and side walls of the NPR brick define a hollow interior space at the central portion of the NPR brick.

In an example, a brick wall includes an NPR brick configured to exhibit NPR behavior and a positive Poisson's ratio (PPR) brick disposed adjacent to the NPR brick. The NPR brick includes substantially flat top and bottom walls; and four side walls, each side wall defining a first angled region angled inwards toward a central portion of the NPR brick. The PPR brick includes substantially flat top and bottom walls; and four side walls, each side wall defining a second angled region angled outwards away from a central portion of the PPR brick. The second angled region of one of the side walls of the PPR brick is nested within the first angled region of one of the side walls of the NPR brick. The brick wall includes mortar disposed between the NPR brick and the PPR brick.

Embodiments can include one or any combination of two or more of the following features.

The top, bottom, and side walls of the NPR brick define a hollow interior space at the central portion of the NPR brick.

The top, bottom, and side walls of the PPR brick define a hollow interior space at the central portion of the PPR brick.

At least some of the side walls of the NPR brick each defines a corner that points toward the central portion of the NPR brick.

At least some of the side walls of the NPR brick each defines a concave profile.

At least some of the side walls of the PPR brick each defines a corner that points away from the central portion of the NPR brick.

At least some of the side walls of the PPR brick each defines a convex profile.

The NPR brick includes an NPR foam material having a Poisson's ratio of less than 0. In some cases, the NPR foam material includes an NPR ceramic foam or an NPR polymer foam. In some cases, the NPR foam material includes an isotropic NPR foam material. In some cases, the NPR foam material is composed of a cellular structure having a characteristic dimension of between 0.1 μm and 3 mm. In some cases, the NPR foam material includes reentrant structures. In some cases, the NPR brick includes a composite material including the NPR foam material and a positive Poisson's ratio (PPR) material.

The mortar includes an NPR foam material.

In an aspect, a method of making a brick wall includes laying an NPR brick and a PPR brick adjacent to one another to form a portion of a row of the brick wall. The NPR brick includes substantially flat top and bottom walls; and four side walls, each side wall defining a first angled region angled inwards toward a central portion of the NPR brick. The PPR brick includes substantially flat top and bottom walls; and four side walls, each side wall defining a second angled region angled outwards away from a central portion of the PPR brick. Laying the NPR brick and the PPR brick includes nesting the second angled region of one of the side walls of the PPR brick within the first angled region of one of the side walls of the NPR brick, and disposing mortar between the NPR brick and the PPR brick.

Other implementations are within the scope of the claims.

DETAILED DESCRIPTION

We describe here construction materials, such as bricks, that exhibit a negative Poisson's ratio ("NPR bricks"). A brick can exhibit a negative Poisson's ratio because of its shape, because it is formed of a material having a negative Poisson's ratio (an "NPR material"), or both. NPR bricks can absorb energy efficiently, thereby exhibiting greater tensile strength, flexibility, impact resistance, and durability than comparable bricks with a positive Poisson's ratio. Brick walls can be formed of a combination of NPR bricks and bricks that exhibit a positive Poisson's ratio ("PPR bricks), which enables efficient energy absorption and provides structural integrity to the wall.

A object with a negative Poisson's ratio (NPR), e.g., a brick exhibiting an NPR (an "NPR brick") is an object that has a Poisson's ratio that is less than zero, such that when the object experiences a positive strain along one axis (e.g., when the object is stretched), the strain in the object along the two perpendicular axes is also positive (e.g., the object expands in cross-section). Conversely, when the object experiences a negative strain along one axis (e.g., when the object is compressed), the strain in the object along a perpendicular axis is also negative (e.g., the object compresses along the perpendicular axis). By contrast, an object with a positive Poisson's ratio (PPR) has a Poisson's ratio that is greater than zero. When an object with a PPR experiences a positive strain along one axis (e.g., when the object is stretched), the strain in the object along the two perpendicular axes is negative (e.g., the object compresses in cross-section), and vice versa.

Figure 1A:
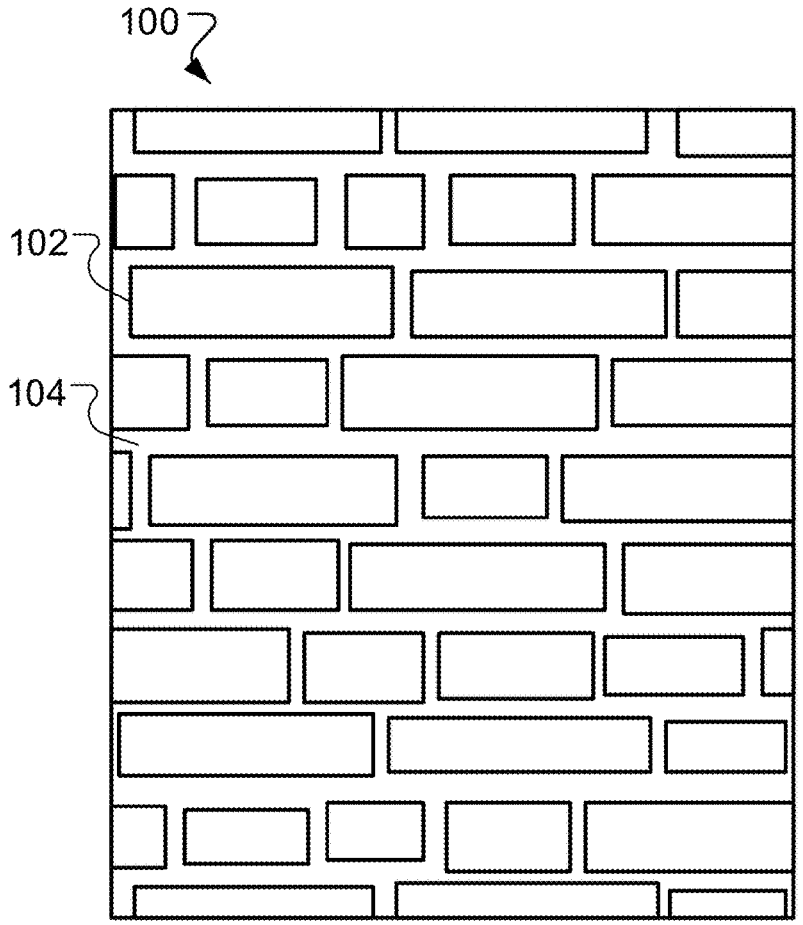
FIG. 1A is a diagram of a brick wall.

FIG. 1A illustrates a brick wall 100 formed of multiple rows of bricks 102. The bricks 102 are arranged in rows that are stacked on top of one another. Adjacent bricks 102 in each row are held together with mortar 104, and adjacent rows are likewise held together with mortar 104. Mortar 104 is a workable paste that binds the bricks 102 together and fills (e.g., seals) gaps between the bricks 102 and that hardens when it cures. Mortars generally are composed of a mixture of sand or another particulate material, a binder (e.g., cement, lime, gypsum, or another suitable binder), and water.

Figure 1B:
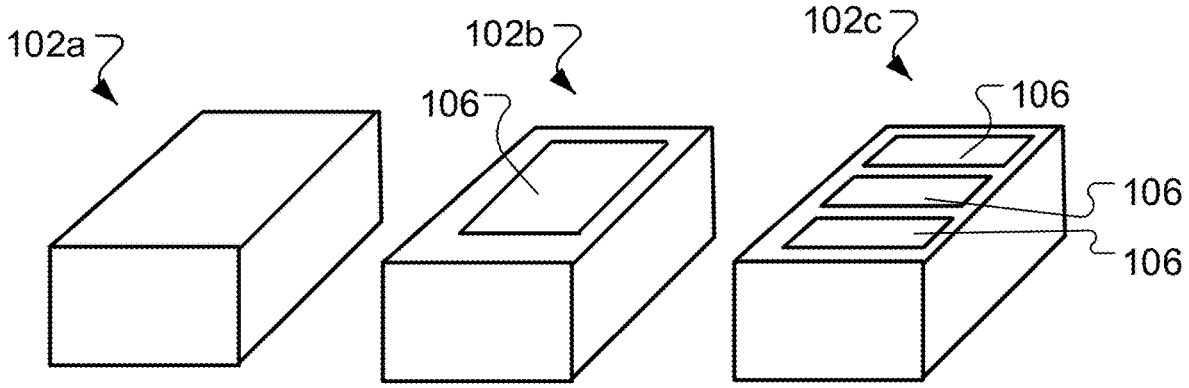
FIG. 1B illustrates types of bricks.

Various types of bricks 102 are available. FIG. 1B. illustrates three types of bricks 102*a*, 102*b*, 102*c*. The brick 102*a* is a solid rectangular prism with no gaps. The brick 102*b* is a rectangular prism with a gap 106 defined in a central region of the brick 102*b*. Although the gap 106 is depicted as rectangular, the gap 106 can be other shapes (e.g., elliptical, triangular, etc.). The gap 106 can extend through the entire thickness of the brick 102*b* or through just a portion of the thickness of the brick 102*b*. The brick 102*c* is a rectangular prism with multiple gaps 106 defined through all or a portion of the thickness of the brick 102*c*. Other brick structures are also possible. Although each of the bricks 102 are depicted as rectangular, in some implementations the bricks 102 can be other shapes (e.g., square, elliptical, triangular, hexagonal, octagonal, etc.). The structure of a brick impacts its characteristics, e.g., its strength-to-weight ratio, flexibility, compressive vs. tensile strength, or other characteristics.

In some examples, all of the bricks 102 of the brick wall 100 have the same structure. In some examples, some bricks 102 of the brick wall 100 have a different structure than other bricks 102 of the brick wall (e.g., some of the bricks can have the structure of the brick 102*a* and other bricks can have the structure of the brick 102*b*, etc.). Using different types of bricks 102 in the brick wall 100 can provide desired characteristics to the wall 100 (e.g., strength, flexibility, durability, etc.).

Some or all of the bricks 102 of the brick wall 100 are NPR bricks that exhibit a negative Poisson's ratio. In some examples, an NPR brick exhibits a negative Poisson's ratio because of its shape, e.g., as discussed below with respect to FIGS. 2 and 3. In some examples, an NPR brick is formed of a material having a negative Poisson's ratio (an "NPR material"). In some examples, an NPR brick both is formed of an NPR material and has a shape that induces NPR behavior. When only some of the bricks 102 in the brick wall are NPR bricks, the remaining bricks 102 are PPR bricks, e.g., bricks exhibiting a positive Poisson's ratio because of their shape, because they are formed of a material having a positive Poisson's ratio (a "PPR material"), or both. In some examples, the mortar 104 is formed of an NPR material, in addition to or instead of the NPR bricks.

The presence of NPR material in the brick wall 100 can contribute to target performance characteristics, such as energy absorption (e.g., mechanical, electrical, magnetic, optical, or acoustic energy), tensile strength, flexibility, impact resistance, durability, low density, high porosity, etc. For example, a wall including NPR bricks can absorb energy from impacts or applied forces, e.g., earthquakes, for instance, absorbing compressive forces both vertically and laterally. Additionally, NPR materials have a lower density than PPR materials, e.g., than PPR materials of a similar composition or than PPR materials having similar mechanical properties, and NPR bricks can thus be lighter in weight than otherwise comparable PPR bricks. NPR materials also generally have a higher porosity than PPR materials, and porous NPR bricks can thus provide a greater surface area for bonding with mortar than otherwise comparable PPR bricks.

NPR materials can include NPR foam materials, such as an NPR ceramic foam, an NPR polymer foam, or an NPR metal foam. NPR ceramic foams include foams of clay, sand, lime, or other suitable ceramics. NPR polymer foams include NPR thermoplastic polymer foams (e.g., polyester polyurethane or polyether polyurethane) or NPR viscoelastic elastomer foams. NPR metal foam include foams of metals such as steel, stainless steel, titanium, aluminum, brass, or other metals, or alloys thereof. A foam is a multi-phase composite material in which one phase is gaseous and the one or more other phases are solid (e.g., polymeric, ceramic, or metal). Foams can be closed-cell foams, in which each gaseous cell is sealed by solid material; open-cell foams, in which the each cell communicates with the outside atmosphere; or mixed, in which some cells are closed and some cells are open.

In some examples, some or all of the bricks 102 in the brick wall are formed of an NPR-PPR composite material that includes both an NPR material (e.g., an NPR foam material) and a PPR material. NPR-PPR composite materials are discussed further below. In some examples, an inner portion (e.g., a core) of a brick includes an NPR material (e.g., is formed of an NPR material or an NPR-PPR composite material), and a PPR material covers the inner portion such that the NPR material of the core is not exposed to the environment. This configuration can provide some of the benefits of an NPR material while also achieving benefits, such as durability, water resistance, or hardness, provided by the PPR material covering. In some examples, an inner layer or core of a brick is a PPR material and the covering includes an NPR material (e.g., is formed of an NPR material or an NPR-PPR composite material).

An example of an NPR foam structure is a re-entrant structure, which is a foam in which the walls of the cells are concave, e.g., protruding inwards toward the interior of the cells. In a re-entrant foam, compression applied to opposing walls of a cell will cause the four other, inwardly directed walls of the cell to buckle inward further, causing the material in cross-section to compress, such that a compression occurs in all directions. Similarly, tension applied to opposing walls of a cell will cause the four inwardly directed walls of the cell to unfold, causing the material in cross-section to expand, such that expansion occurs in all directions. NPR foams can have a Poisson's ratio of between −1 and 0, e.g., between −0.8 and 0, e.g., −0.8, −0.7, −0.6, −0.5, −0.4, −0.3, −0.2, or −0.1. NPR foams can have an isotropic Poisson's ratio (e.g., Poisson's ratio is the same in all directions) or an anisotropic Poisson's ratio (e.g., Poisson's ratio when the foam is strained in one direction differs from Poisson's ratio when the foam is strained in a different direction).

Figure 2:
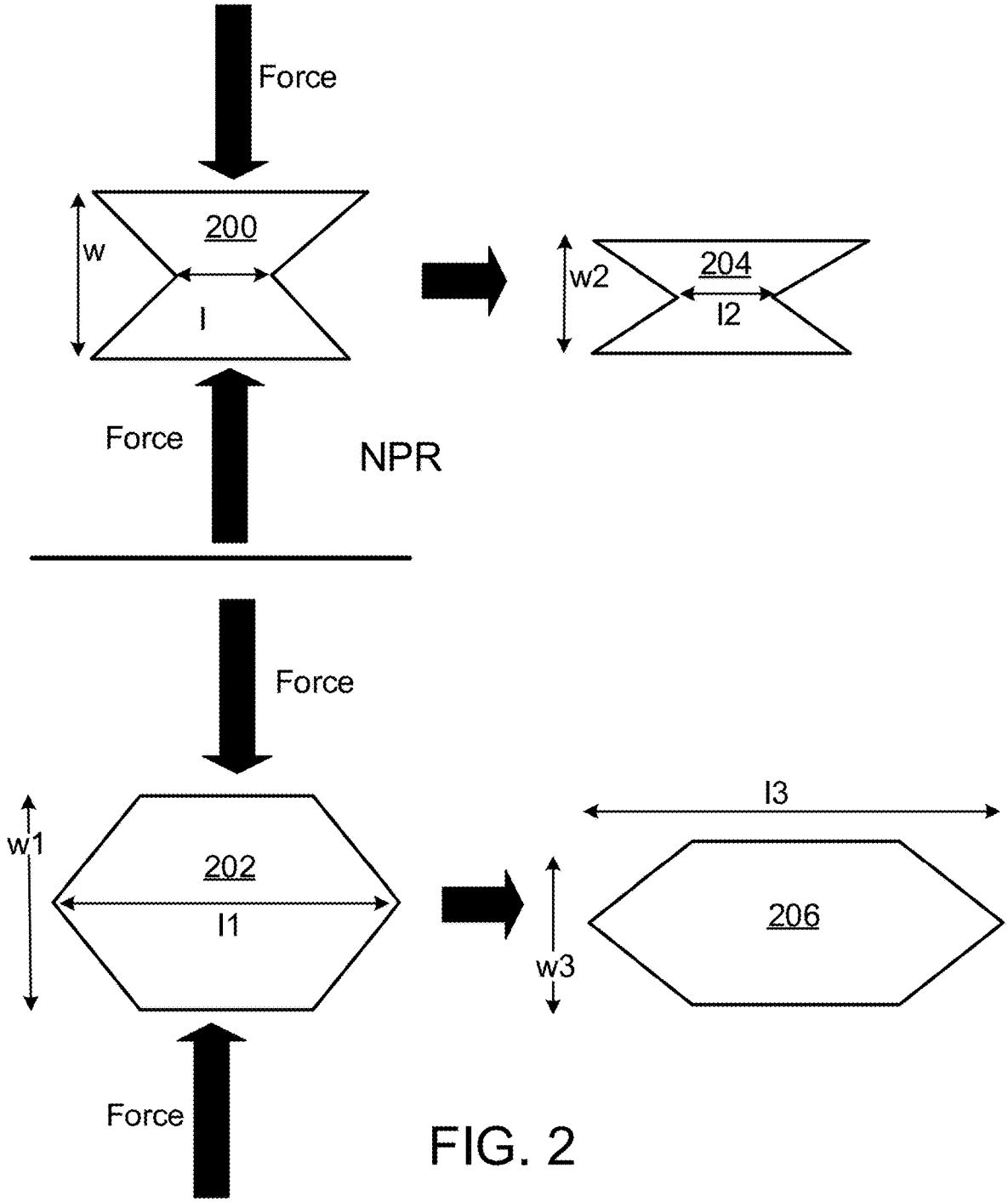
FIG. 2 is a diagram of negative and positive Poisson's ratio structures

FIG. 2 illustrates a cell 200 of an NPR reentrant foam structure that exhibits a negative Poisson's ratio, and a cell 202 of a PPR foam structure that exhibits a positive Poisson's ratio. The cell 200 of the NPR foam structure has length l and width w, and the cell 202 of the PPR foam structure has length l1 and width w1. When a force is applied along the width of the cell 200 of the NPR foam structure, the cell deforms into the shape shown as deformed cell 204. Both the width w2 and the length l2 of the deformed cell 204 are less than the width w and length l, respectively, of the cell 200: the cell compresses along both its width and its length. By contrast, when a force is applied along the width of the cell 202 of the PPR foam structure, the cell deforms into the shape shown as deformed cell 206. The width w3 of deformed cell 206 is less than the width w1 of cell 202, and the length l3 of cell 206 is greater than the length l3 of cell 202: the material compresses along its width and expands along its length.

In some examples, the bricks of a brick wall are shaped to mimic the reentrant cell 200 of an NPR foam structure and the cell 202 of a PPR foam structure. Specifically, referring to FIG. 3, two bricks 300, 302 form part of a row 304 of a brick wall. Each brick 300, 302 includes an outer wall that defines a hollow interior 306, 308, respectively. In some examples, one or both of the bricks 300, 302 is not hollow but instead is solid through its entire thickness.

Figure 3:
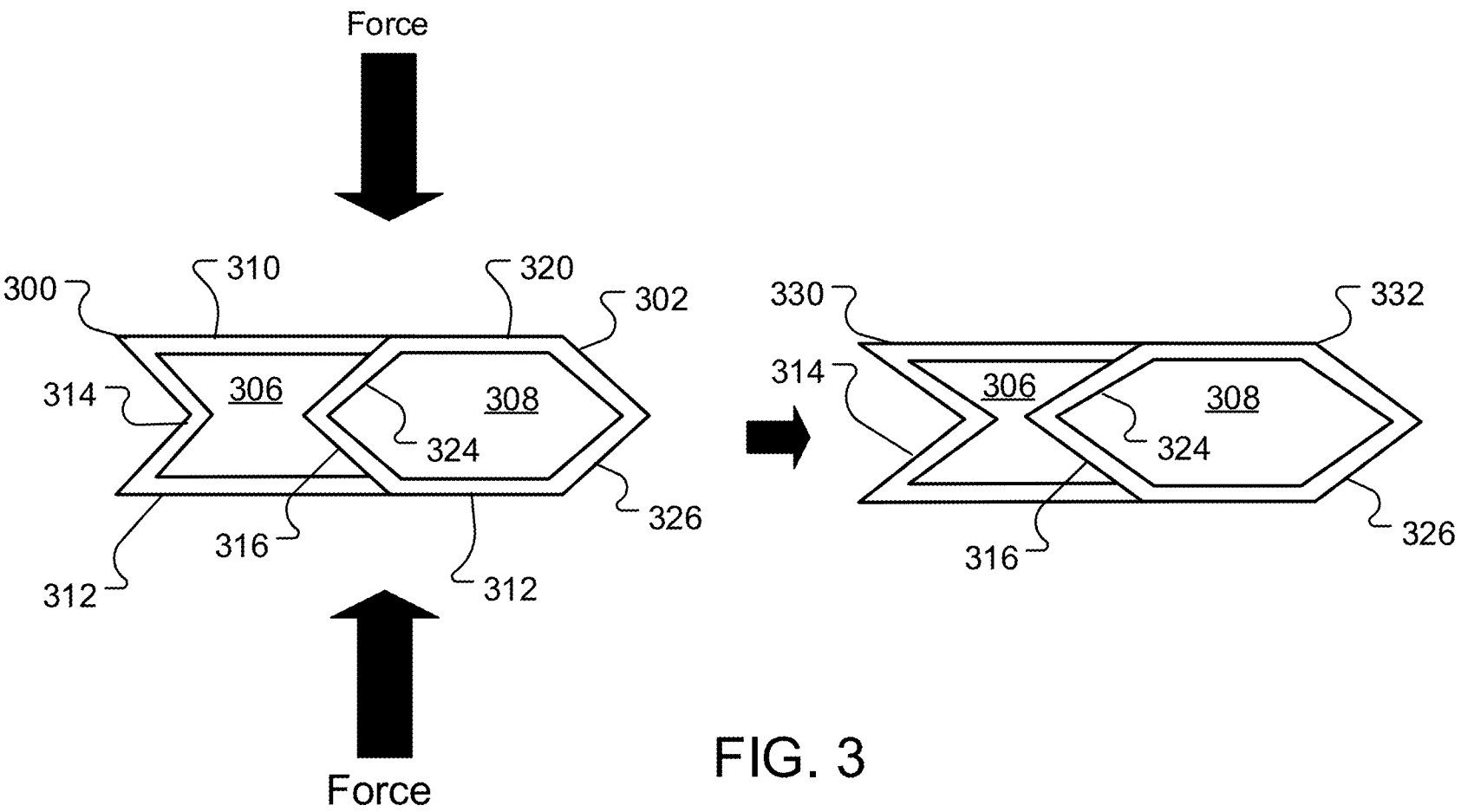
FIG. 3 is a diagram of bricks with negative and positive Poisson's ratios.

The brick 300 (an "NPR brick") is structured to mimic the reentrant cell 200 of an NPR foam structure, and exhibits NPR behavior. The outer wall of the NPR brick 300 includes top and bottom walls 310, 312 that are substantially flat, and four side walls (two of which, 314, 16 are shown in FIG. 3) each of which has an angled region that points inwards toward the hollow interior 306 of the brick 300. In the example of FIG. 3, each of the angled side walls 314, 316 has a sharp corner that points inwards toward the hollow interior 306; in some examples, each of the angled side walls of the NPR brick has a smooth concave profile that points inwards toward the hollow interior 306. When the NPR brick 300 is solid rather than hollow, the angled portion of each side wall points inwards toward a central (solid) region of the brick 300.

The brick 302 (a "PPR brick") is structured to mimic the cell 202 of a PPR foam structure, and exhibits PPR behavior. The outer wall of the PPR brick 302 includes top and bottom walls 320, 322 that are substantially flat, and each of four side walls (two of which, 324, 326 are shown in FIG. 3) has an angled region that is angled outwards away from the hollow interior 308 of the brick 302. In the example of FIG. 3, each of the angled side walls of the PPR brick 302 has a sharp corner that points outwards away from the hollow interior 308; in some examples, each of the angled side walls has a smooth convex profile that points outwards away from the hollow interior 306. When the PPR brick 302 is solid rather than hollow, the angled portion of each side wall points outwards away from a central (solid) region of the brick 302.

The angled region of the side wall 324 of the PPR brick 302 nests within the angled region of the side wall 316 of the adjacent NPR brick 300. The bricks 300, 302 are attached together by mortar, not shown, disposed between the bricks.

When a compressive force is applied to the row 304 of bricks, the row deforms into the shape shown as deformed row 305. By analogy with the cells 200, 202 of FIG. 2, the NPR brick 300 contracts in dimension both in the direction of the applied compressive force and in the direction perpendicular to the applied compressive force into a deformed brick 330: the width and length of the deformed brick 330 are both less than the width and length of the NPR brick 300 prior to application of compressive force. Specifically, the angled region of each side wall 314, 316 collapses inwards, shrinking the lateral dimension of the NPR brick. The PPR brick 302 contracts in the direction of the applied force and expands in the direction perpendicular to the applied force into a deformed brick 332: the width of the deformed brick 332 is less than the width of the PPR brick 302, while the length of the deformed brick 332 is greater than the length of the PPR brick 302. Specifically, the angled region of each side wall 324, 326 collapses outwards, increasing the lateral dimension of the PPR brick. Because the NPR brick 300 compresses along both its width and its length, and the PPR brick 302 compresses along its width and expands along its length, the expansion and compression of the two bricks 300, 302 complement one another such that the row 300 compresses along its thickness while remaining substantially the same length, and the bricks 300, 302 remain in contact.

This structural response can provide strength and resilience to a brick wall incorporating alternating NPR bricks and PPR bricks. For example, when an earthquake occurs, imposing compressive forces vertically and laterally on the bricks of a wall, adjacent NPR and PPR bricks can expand and compress in harmony to maintain the integrity of the wall.

In some examples, NPR bricks 300 are formed of an NPR material (e.g., an NPR foam material, such as an NPR polymer foam, an NPR ceramic foam, or an NPR metal foam) or an NPR-PPR composite material such that both the material and the NPR brick 300 as a whole exhibit NPR behavior. In some examples, NPR bricks are formed of PPR material, such that their NPR behavior is provided solely by the reentrant structure of the brick. In some examples, the mortar between adjacent bricks includes an NPR material.

To make a brick wall including both NPR and PPR bricks, an NPR brick is laid adjacent to a PPR brick such that the angled region of one of the side walls of the PPR brick is nested within the angled region of one of the side walls of the NPR brick. Mortar is disposed between the two bricks to hold them together.

Figure 4:
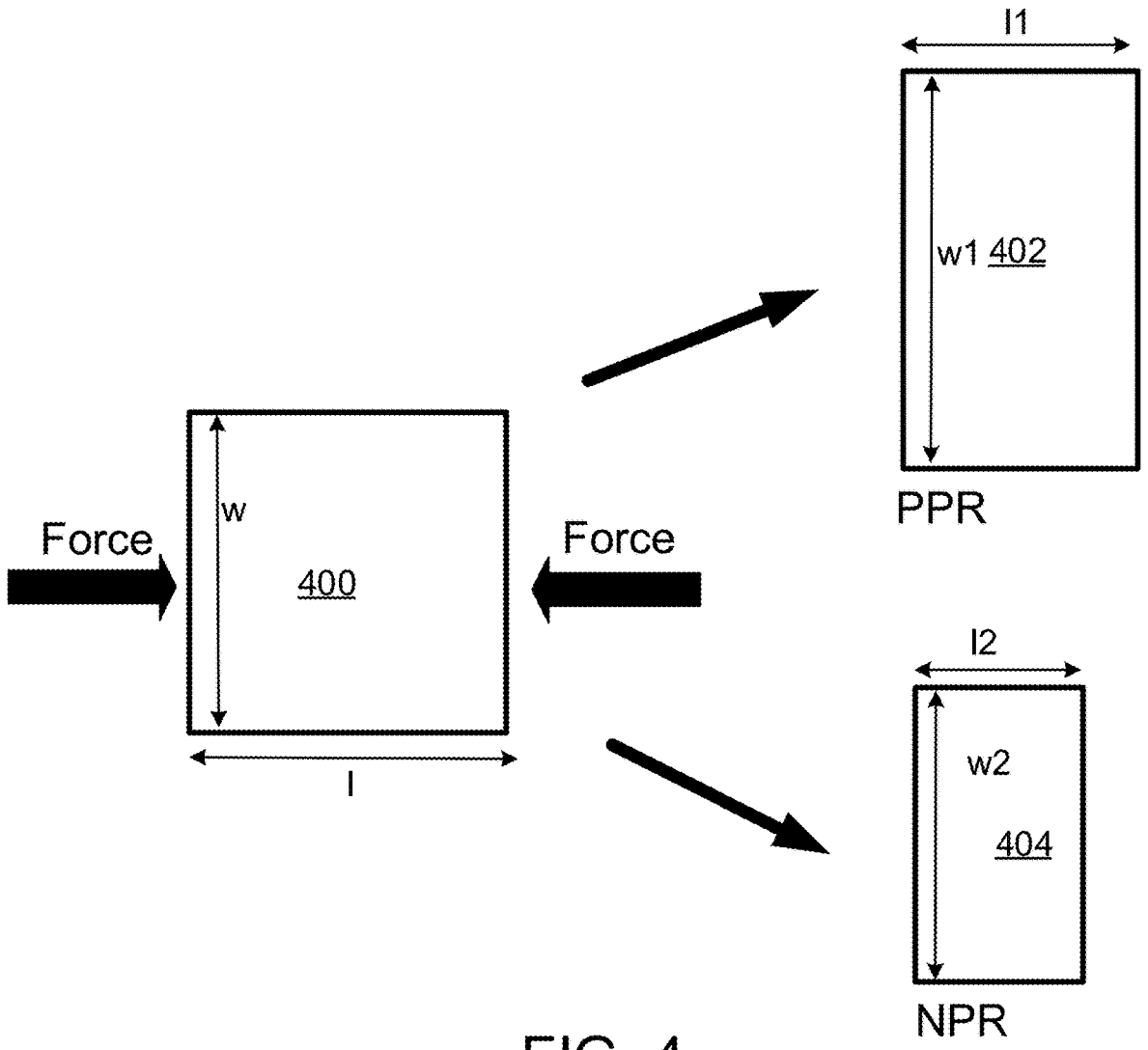
FIG. 4 is an illustration of materials with negative and positive Poisson's ratios.

More materials with negative and positive Poisson's ratios are illustrated in FIG. 4, which depicts a hypothetical two-dimensional block of material 400 with length l and width w.

If the hypothetical block of material 400 is a PPR material, when the block of material 400 is compressed along its width w, the material deforms into the shape shown as block 402. The width w1 of block 402 is less than the width w of block 400, and the length l1 of block 402 is greater than the length l of block 400: the material compresses along its width and expands along its length.

By contrast, if the hypothetical block of material 400 is an NPR material, when the block of material 400 is compressed along its width w, the material deforms into the shape shown as block 404. Both the width w2 and the length l2 of block 404 are less than the width w and length 1, respectively, of block 400: the material compresses along both its width and its length.

NPR materials for bricks can be foams, such as polymeric foams, ceramic foams, metal foams, or combinations thereof. A foam is a multi-phase composite material in which one phase is gaseous and the one or more other phases are solid (e.g., polymeric, ceramic, or metal). Foams can be closed-cell foams, in which each gaseous cell is sealed by solid material; open-cell foams, in which the each cell communicates with the outside atmosphere; or mixed, in which some cells are closed and some cells are open.

An NPR foam can be polydisperse (e.g., the cells of the foam are not all of the same size) and disordered (e.g., the cells of the foam are randomly arranged, as opposed to being arranged in a regular lattice). An NPR foam can be a cellular structure having a characteristic dimension (e.g., the size of a representative cell, such as the width of the cell from one wall to the opposing wall) ranging from 0.1 μm to about 3 mm, e.g., about 0.1 μm, about 0.5 μm, about 1 μm, about 10 μm, about 50 μm, about 100 μm, about 500 μm, about 1 mm, about 2 mm, or about 3 mm.

In some examples, NPR foams are produced by transformation of PPR foams to change the structure of the foam into a structure that exhibits a negative Poisson's ratio. In some examples, NPR foams are produced by transformation of nanostructured or microstructured PPR materials, such as nanospheres, microspheres, nanotubes, microtubes, or other nano- or microstructured materials, into a foam structure that exhibits a negative Poisson's ratio. The transformation of a PPR foam or a nanostructured or microstructured material into an NPR foam can involve thermal treatment (e.g., heating, cooling, or both), application of pressure, or a combination thereof. In some examples, PPR materials, such as PPR foams or nanostructured or microstructured PPR materials, are transformed into NPR materials by chemical processes, e.g., by using glue. In some examples, NPR materials are fabricated using micromachining or lithographic techniques, e.g., by laser micromachining or lithographic patterning of thin layers of material. In some examples, NPR materials are fabricated by additive manufacturing (e.g., three-dimensional (3D) printing) techniques, such as stereolithography, selective laser sintering, or other appropriate additive manufacturing technique.

In an example, a PPR thermoplastic foam, such as an elastomeric silicone film, can be transformed into an NPR foam by compressing the PPR foam, heating the compressed foam to a temperature above its softening point, and cooling the compressed foam. In an example, a PPR foam composed of a ductile metal can be transformed into an NPR foam by uniaxially compressing the PPR foam until the foam yields, followed by uniaxially compression in other directions.

In some examples, NPR foams are produced by transformation of PPR foams to change the structure of the foam into a structure that exhibits a negative Poisson's ratio. In some examples, NPR foams are produced by transformation of nanostructured or microstructured PPR materials, such as nanospheres, microspheres, nanotubes, microtubes, or other nano- or microstructured materials, into a foam structure that exhibits a negative Poisson's ratio. The transformation of a PPR foam or a nanostructured or microstructured material into an NPR foam can involve thermal treatment (e.g., heating, cooling, or both), application of pressure, or a combination thereof. In some examples, PPR materials, such as PPR foams or nanostructured or microstructured PPR materials, are transformed into NPR materials by chemical processes, e.g., by using glue. In some examples, NPR materials are fabricated using micromachining or lithographic techniques, e.g., by laser micromachining or lithographic patterning of thin layers of material. In some examples, NPR materials are fabricated by additive manufacturing (e.g., three-dimensional (3D) printing) techniques, such as stereolithography, selective laser sintering, or other appropriate additive manufacturing technique.

In an example, a PPR thermoplastic foam, such as an elastomeric silicone film, can be transformed into an NPR foam by compressing the PPR foam, heating the compressed foam to a temperature above its softening point, and cooling the compressed foam. In an example, a PPR foam composed of a ductile metal can be transformed into an NPR foam by uniaxially compressing the PPR foam until the foam yields, followed by uniaxially compression in other directions.

NPR-PPR composite materials are composites that include both regions of NPR material and regions of PPR material. NPR-PPR composite materials can be laminar composites, matrix composites (e.g., metal matrix composites, polymer matrix composites, or ceramic matrix composites), particulate reinforced composites, fiber reinforced composites, or other types of composite materials. In some examples, the NPR material is the matrix phase of the composite and the PPR material is the reinforcement phase, e.g., the particulate phase or fiber phase. In some examples, the PPR material is the matrix phase of the composite and the NPR material is the reinforcement phase.

NPR materials can exhibit various desirable properties, including high shear modulus, effective energy absorption, and high toughness (e.g., high resistance to indentation, high fracture toughness), among others. The properties of NPR materials are such that a brick that includes an NPR material (an "NPR brick") undergoes a different (e.g., smaller) change in dimension when absorbing energy than a comparable brick formed of only PPR material (a "PPR brick").

The compressibility of a brick wall affects the elastic deformation (e.g., compression) experienced by the brick wall when it absorbs energy from impacts. A suitable amount of deformation enables bricks to expand and compress to maintain the integrity of the brick wall (e.g., during an earthquake). A highly deformable brick wall will have a large amount deformation when absorbing impact and may be inefficient in supporting compressive loads (e.g., supporting the weight of a roof on a building). To design a brick wall that is capable of efficiently absorbing impact, the material of the brick or the mortar can be selected to balance rigidity and elasticity. NPR materials can be incorporated into the brick wall to provide the brick wall with a desired deformability (e.g., rigidity) and strength.

Figure 5:
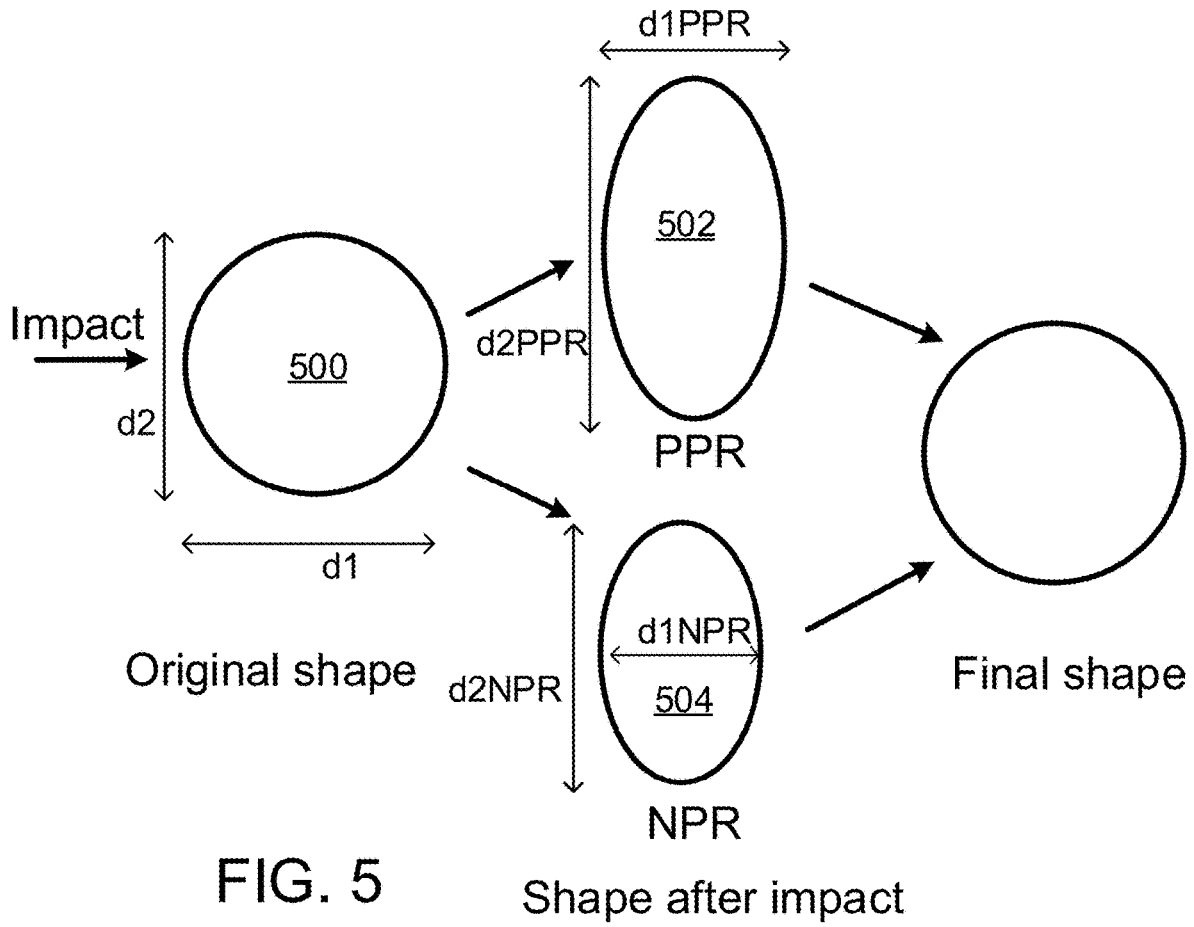
FIG. 5 is an illustration of balls with negative and positive Poisson's ratios.

FIG. 5 shows a schematic depiction of the change in diameter of a material 500 upon impact. Although the material 500 in FIG. 5 is shown as a rounded ball, a similar deformation occurs in materials of other shapes. Prior to impact, the material 500 has a diameter d1 in the direction of the impact and a diameter d2 in the direction perpendicular to the impact. If the material 500 is a PPR material, the material undergoes significant deformation (e.g., elastic deformation) into a shape 502, such that the diameter in the direction of the impact decreases to d1PPR and the diameter in the direction perpendicular to the impact increases to d2PPR. By contrast, if the material 500 is an NPR material, the material undergoes less extensive deformation into a shape 504. The diameter of the shape 504 in the direction of the impact decreases to d1NPR, which is approximately the same as d1PPR. However, the diameter of the shape 504 in the direction perpendicular to the impact also decrease, to d2NPR. The magnitude of the difference between d2 and d2NPR is less than the magnitude of the difference between d2 and d2PPR, meaning that the NPR material undergoes less deformation than the PPR ball.

Figure 6A:
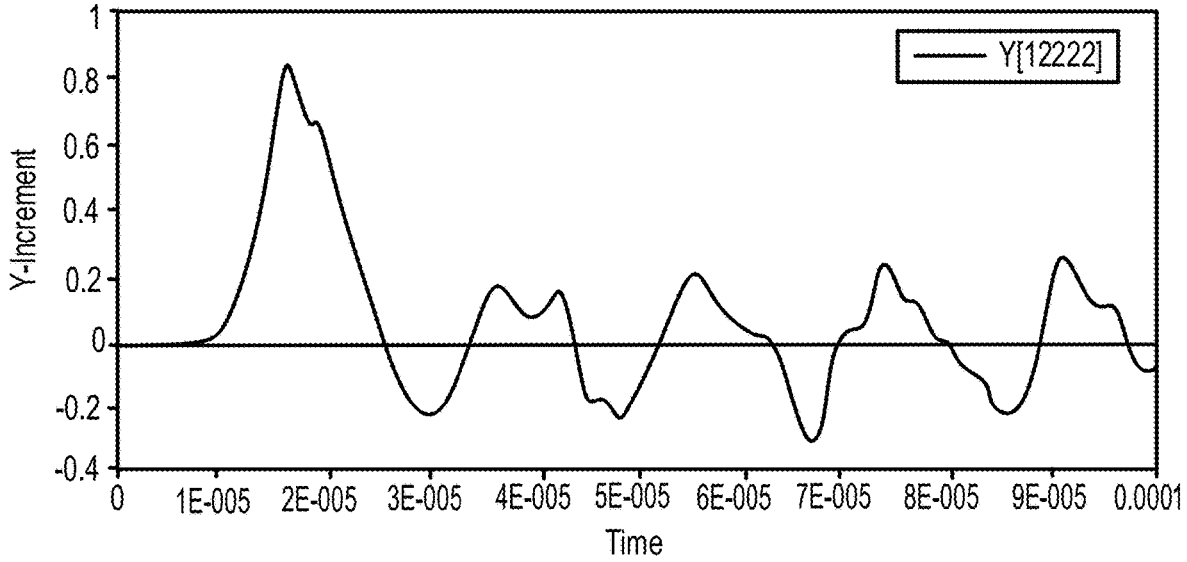
FIGS. 6A and 6B are plots of diameter versus time.
Figure 6B:
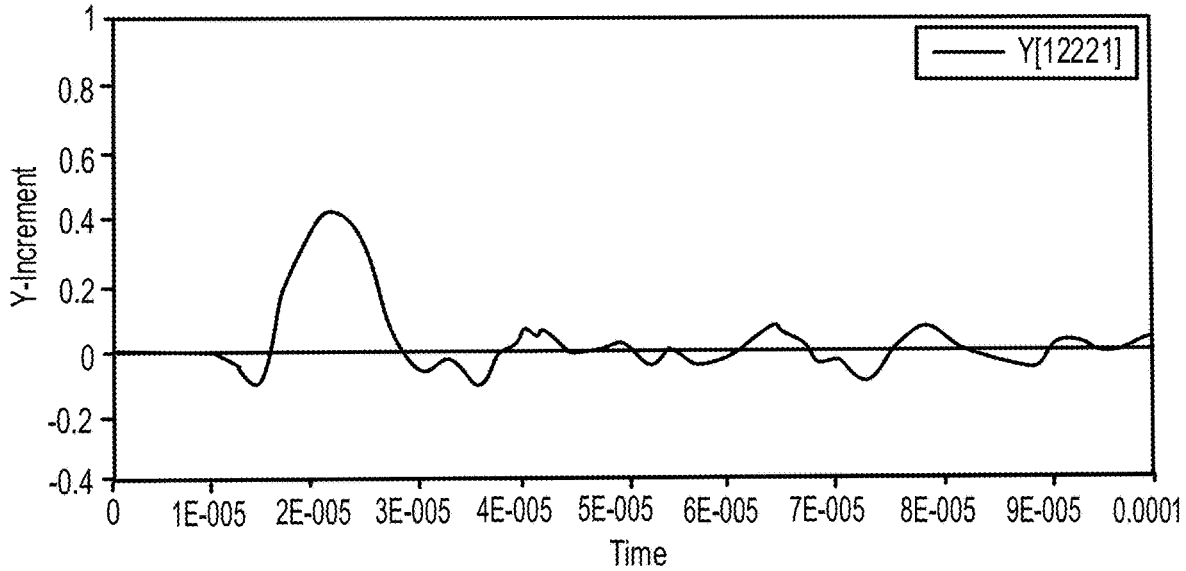

FIGS. 6A and 6B show plots of diameter versus time for a substantially spherical PPR material with a Poisson's ratio of 0.45 and an NPR material with a Poisson's ratio of −0.45, respectively, responsive to being struck with an equivalent force. In this example, the NPR material undergoes a smaller initial change in diameter than does the PPR material, and the oscillations in diameter are smaller in magnitude and dampen more quickly. Again, although FIGS. 6A and 6B are specific to substantially spherical materials, a similar behavior occurs in NPR and PPR materials of other shapes. The material of a brick can be selected to balance rigidity and elasticity.

Figure 7:
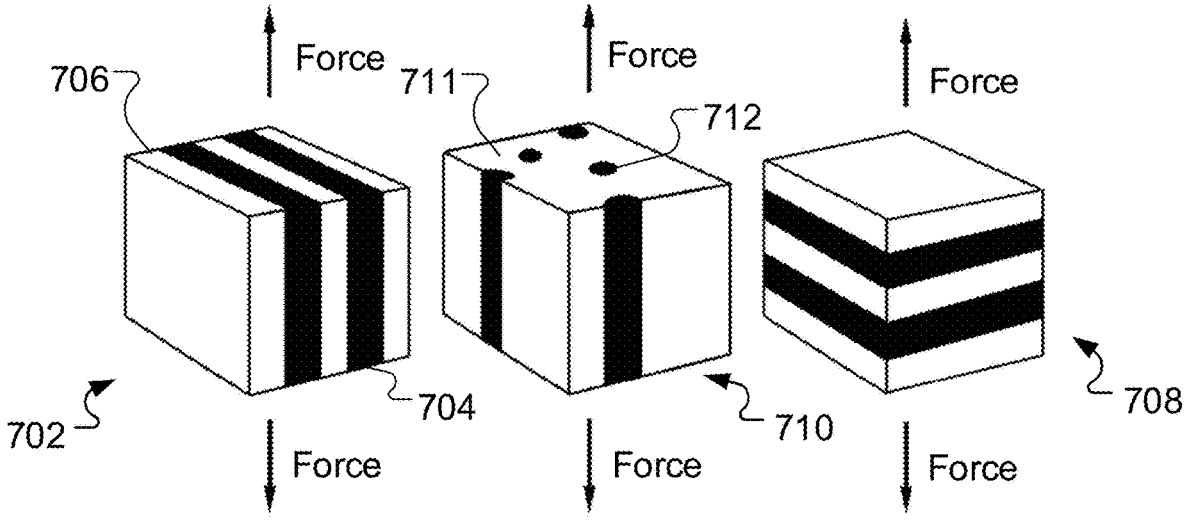
FIG. 7 is an illustration of composite materials.

FIG. 7 illustrates examples of NPR-PPR composite materials. An NPR-PPR composite material 702 is a laminar composite including alternating layers 704 of NPR material and layers 706 of PPR material. The layers 704, 706 are arranged in parallel to a force to be exerted on the composite material 702. Although the layers 704, 706 are shown as having equal width, in some examples, a laminar composite can have layers of different widths.

An NPR-PPR composite material 708 is a laminar composite including alternating layers of NPR material and PPR material, with the layers arranged perpendicular to a force to be exerted on the material 708. In some examples, the layers of a laminar composite are arranged at an angle to the expected force that is neither perpendicular nor parallel.

An NPR-PPR composite material 712 is a matrix composite including a matrix phase 711 of NPR material with a reinforcement phase 712 of PPR material. In the material 712, the reinforcement phase 712 includes fibers of the PPR material; in some examples, the reinforcement phase 712 can include particles or other configuration. In some examples, NPR-PPR composite materials can have a matrix phase of a PPR material with a reinforcement phase of an NPR material.

Figure 8:
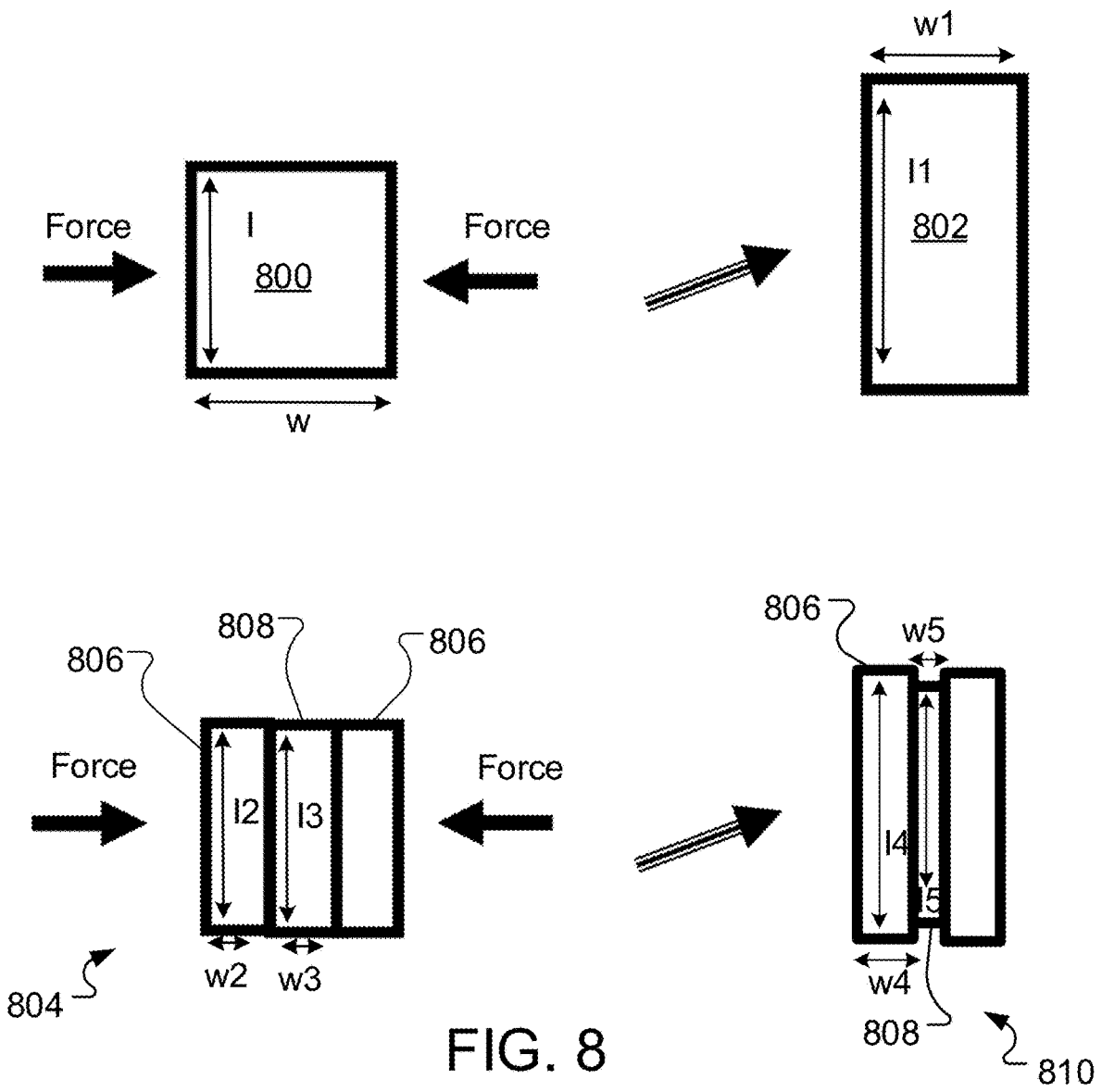
FIG. 8 is an illustration of a material with a positive Poisson's ratio and a composite material.

FIG. 8 illustrates the mechanical behavior of PPR and NPR/PPR composite materials. A hypothetical block 800 of PPR material, when compressed along its width w, deforms into a shape 802. The width w1 of the compressed block 802 is less than the width w of the uncompressed block 800, and the length l1 of the compressed block 802 is greater than the length l of the uncompressed block: the material compresses along the axis to which the compressive force is applied and expands along a perpendicular axis.

A block 804 of NPR/PPR composite material includes a region 808 of NPR material sandwiched between two regions 806 of PPR material. When the block 804 of composite material is compressed along its width, the material deforms into a shape 810. The PPR regions 806 compress along the axis of compression and expand along a perpendicular axis, e.g., as described above for the block 800 of PPR material, such that, e.g., the width w2 of a region 806 of uncompressed PPR material compresses to a smaller width w4 and the length l2 of the region 806 expands to a greater length l4. In contrast, the NPR region 808 compresses along both the axis of compression and along the perpendicular axis, such that, e.g., both the width w3 and length l3 of the uncompressed NPR region 808 are greater than the width w5 and length l5 of the compressed NPR region 808.

Figure 9:
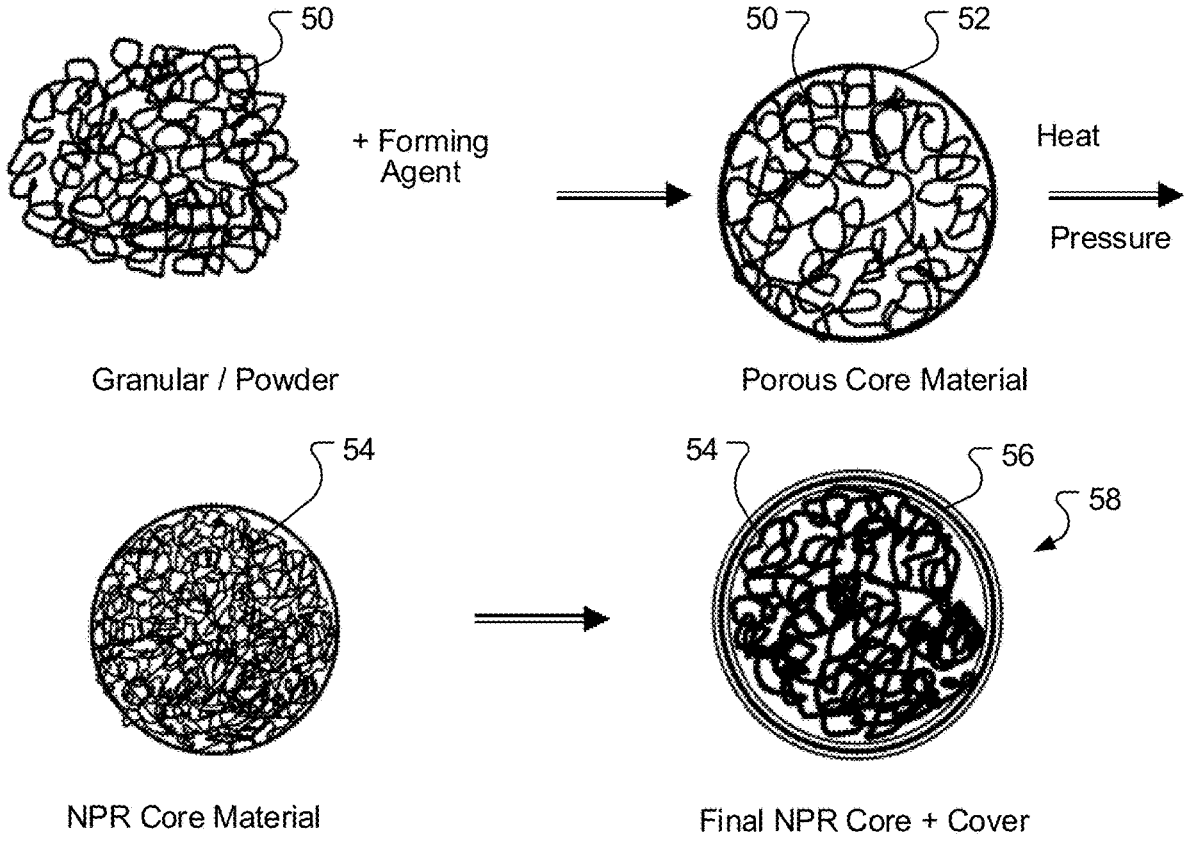
FIG. 9 is an illustration of a method of making an NPR material.

FIG. 9 illustrates an example method of making an object, such as a portion of a brick, formed of an NPR material. A granular or powdered material, such as a polymer material (e.g., a rubber) is mixed with a foaming agent to form a porous material 50. The porous material 50 is placed into a mold 52. Pressure is applied to compress the material 50 and the compressed material is heated to a temperature above its softening point. The material is then allowed to cool, resulting in an NPR foam 54. The NPR foam 54 is covered with an outer layer 56, such as a polymer layer, and heat and pressure is applied again to cure the final material into an object 58.

In some examples, a material can be formed into an NPR material by forming nanoscale or microscale structures, such as spheres or tubules, with the material.

Other methods can also be used to fabricate an object formed of an NPR material or an NPR-PPR composite material, such as a brick. For example, various additive manufacturing (e.g., 3D printing) techniques, such as stereolithography, selective laser sintering, or other appropriate additive manufacturing technique, can be implemented to fabricate an object formed of an NPR material or an NPR-PPR composite. In some examples, different components of the object are made by different techniques. For example, a portion of a brick wall (e.g., a brick) may be 3D printed while the mortar is not, or vice versa. Additive manufacturing techniques can enable seams to be eliminated.

Other embodiments are within the scope of the following claims.

What is claimed is:

1. A brick comprising:
outer walls comprising:
top and bottom walls; and
side walls angled inwards toward a central portion of the brick, such that application of a compressive force between the top and bottom walls causes a lateral dimension of the brick between opposite side walls to decrease,
in which at least some of the outer walls of the brick include a material having a negative Poisson's ratio (NPR).

2. The brick of claim 1, in which the at least some of the outer walls of the brick include an NPR foam material.

3. The brick of claim 2, in which the outer walls of the brick include an NPR ceramic foam.

4. The brick of claim 2, in which the outer walls of the brick include an NPR polymer foam.

5. The brick of claim 2, in which the NPR foam material comprises an isotropic NPR foam material.

6. The brick of claim 2, in which at least some of the side walls each defines a corner that points toward the central portion of the brick.

7. The brick of claim 2, in which at least some of the side walls each defines a concave profile.

8. The brick of claim 2, in which the top, bottom, and side walls of the brick define a hollow interior space at the central portion of the brick.

9. A brick wall comprising:
an NPR brick configured to exhibit NPR behavior, the NPR brick comprising:
top and bottom walls; and
four side walls, each side wall defining a first angled region angled inwards toward a central portion of the NPR brick;
a positive Poisson's ratio (PPR) brick disposed adjacent to the NPR brick, the PPR brick comprising:
top and bottom walls; and four side walls, each side wall defining a second angled region angled outwards away from a central portion of the PPR brick, wherein the second angled region of one of the side walls of the PPR brick is nested within the first angled region of one of the side walls of the NPR brick; and mortar disposed between the NPR brick and the PPR brick.

10. The brick wall of claim 9, in which the top, bottom, and side walls of the NPR brick define a hollow interior space at the central portion of the NPR brick.

11. The brick wall of claim 9, in which the top, bottom, and side walls of the PPR brick define a hollow interior space at the central portion of the PPR brick.

12. The brick wall of claim 9, in which at least some of the side walls of the NPR brick each defines a corner that points toward the central portion of the NPR brick.

13. The brick of claim 9, in which at least some of the side walls of the NPR brick each defines a concave profile.

14. The brick wall of claim 9, in which at least some of the side walls of the PPR brick each defines a corner that points away from the central portion of the NPR brick.

15. The brick of claim 9, in which at least some of the side walls of the PPR brick each defines a convex profile.

16. The brick wall of claim 9, in which the NPR brick comprises an NPR foam material having a Poisson's ratio of less than 0.

17. The brick wall of claim 9, in which the NPR foam material comprises an NPR ceramic foam.

18. The brick wall of claim 9, in which the NPR foam material comprises an NPR polymer foam.

19. The brick of claim 9, in which the NPR foam material comprises an isotropic NPR foam material.

20. The brick wall of claim 9, in which the NPR foam material comprises reentrant structures.

21. The brick wall of claim 9, in which the NPR brick comprises a composite material comprising the NPR foam material and a positive Poisson's ratio (PPR) material.

22. The brick wall of claim 9, in which the mortar comprises an NPR foam material.

* * * * *